US006478281B2

(12) United States Patent
Turner

(10) Patent No.: US 6,478,281 B2
(45) Date of Patent: Nov. 12, 2002

(54) CONTINUOUS PALETTE

(75) Inventor: William H. Turner, Melfa, VA (US)

(73) Assignee: Wood Tech, LLC, Melfa, VA (US)

( * ) Notice: Subject to any disclaimer, the term of this patent is extended or adjusted under 35 U.S.C. 154(b) by 0 days.

(21) Appl. No.: 09/779,648

(22) Filed: Feb. 9, 2001

(65) Prior Publication Data

US 2002/0109030 A1 Aug. 15, 2002

(51) Int. Cl.[7] ..... A47B 97/04; B65H 18/10

(52) U.S. Cl. ..... 248/441.1; 242/538.3; 40/518; 108/50.17

(58) Field of Search ..... 242/538.3, 538.1; 40/483, 518; 248/441.1, 442.2, 447, 447.1, 447.2, 448, 449, 450, 451, 460–465; 108/26, 50.17

(56) References Cited

U.S. PATENT DOCUMENTS

| | | | | | |
|---|---|---|---|---|---|
| 149,884 | A | * | 4/1874 | Russell | 40/518 |
| 633,604 | A | * | 9/1899 | Miles | 242/538.3 |
| 1,571,610 | A | * | 2/1926 | Tingley | 242/538.3 |
| 1,714,639 | A | * | 5/1929 | Shaeffer | 40/518 |
| 1,752,614 | A | * | 4/1930 | Ring | 40/518 |
| 2,163,523 | A | * | 6/1939 | Whitmyre | 242/538.3 |
| 2,792,653 | A | * | 5/1957 | Bozich | 242/538.3 |
| 3,738,685 | A | * | 6/1973 | Penner | 242/538.3 |
| 4,061,287 | A | | 12/1977 | Shakespeare | |
| 4,234,134 | A | | 11/1980 | Rhine | |
| 4,277,033 | A | * | 7/1981 | Swenson | 242/538.3 |
| 4,453,470 | A | | 6/1984 | Capella | 108/26 |
| 4,560,990 | A | | 12/1985 | Sue et al. | 346/17 |
| 4,755,254 | A | | 7/1988 | Bedwell | 156/554 |
| 5,565,253 | A | | 10/1996 | Crawford et al. | 428/68 |
| 5,577,917 | A | | 11/1996 | Mock | 434/304 |
| 5,769,350 | A | | 6/1998 | Oka | 242/422.4 |
| 5,899,429 | A | | 5/1999 | McCloud | 248/441.1 |
| 6,012,674 | A | | 1/2000 | Leeuwenburgh | 242/588.6 |

* cited by examiner

*Primary Examiner*—John M. Jillions
(74) *Attorney, Agent, or Firm*—John H. Thomas, P.C.

(57) ABSTRACT

A continuous palette assembly includes a frame, a windup roller, a feed roller, and paper. The frame has a palette surface and a feed chamber adapted to carry the feed roller, the feed chamber being open to the palette surface. The windup roller is mounted onto the frame so that the windup roller is free to move rotationally. The feed roller and windup roller are each adapted to have paper rolled around them, wherein paper unrolled from the feed roller passes across the palette surface and is rolled up around the windup roller.

2 Claims, 4 Drawing Sheets

CONTINUOUS PALETTE

This invention relates to a painter's palette, and alternatively, to a portable painter's box having a continuous palette feature. The continuous palette may be attached to an easel or any other convenient object, or it may simply be carried by itself.

BACKGROUND OF THE INVENTION

Palettes have been used by painters for hundreds of years to mix and temporarily hold paint to be used in the artist's work. Traditionally, a palette is a board or other surface onto which raw paint is dumped by an artist before mixing it and/or brushing it onto a canvas or other work surface. Depending on the palette surface, the paint used, or the way the paint is used, it can be difficult for an artist to clean off a palette surface after use.

There are several conventional methods for solving this dirty palette problem. First, the surface of the palette may be made from Formica, glass, or a smooth plastic that is easily cleaned and wiped off. Also, disposable palette boards may be used and simply thrown away. Also, paper, including a continuous roll of paper may be used where the pieces of paper or sections of paper can act as a palette surface and then simply be discarded after use. Each of these conventional solutions can cause a mess with the frequent cleaning or disposing of a palette.

SUMMARY OF THE INVENTION

Accordingly, it is an object of the present invention to overcome the foregoing drawbacks of conventional palette assemblies and to provide a continuous, renewable palette for an artist. The invention includes a feed roll of paper and windup roller for allowing an artist to continuously use clean paper as a palette. The "used roll" can be conveniently disposed of after use. The artist does not have to worry about the substantial clean up and disposal problems that might otherwise occur.

In one embodiment, the continuous palette assembly comprises a frame, a windup roller, a feed roller, and paper. The frame comprises a palette surface and a feed chamber adapted to carry the feed roller, the feed chamber being open to the palette surface. The windup roller is mounted onto the frame so that the windup roller is free to move rotationally. The feed roller and windup roller are each adapted to have paper rolled around them. Accordingly, the paper is unrolled from the feed roller, passes across the palette surface, and is rolled up around the windup roller. This assembly may further have a box like configuration of the frame wherein the palette surface is the top of the box and windup roller is mounted underneath the palette surface. Still further, the feed chamber can be open to the palette surface through an aperture in the frame, the aperture being adapted to allow paper to pass through it. Also, the feed roller can be mounted onto the frame so that the feed roller is free to move rotationally. In a further alternative, the assembly may comprise tensioning collars around the feed roller and/or windup roller. The assembly may further comprise a connector that is adapted to attach the assembly to an easel. The frame may also comprise a storage chamber.

In an alternative embodiment, the continuous palette assembly may comprise a frame, a windup roller, and a roll of paper. The frame comprises a palette surface and a feed chamber adapted to carry the roll of paper, the feed chamber being open to the palette surface. The windup roller is mounted onto the frame so that the windup roller is free to move rotationally and is adapted to have paper rolled around it. Accordingly, paper is unrolled from the roll of paper, passes across the palette surface, and is rolled up around the windup roller. Also, the frame can be a box like configuration with the palette surface as the top of the box, and the windup roller mounted underneath the palette surface. The feed chamber can be open to the palette surface through an aperture in the frame, the aperture adapted to allow paper to pass through it. The assembly may further comprise a connector adapted to attach the assembly to a easel. The frame may further comprise a storage chamber.

In a still further embodiment, the continuous palette assembly may comprise a frame, a windup roller, a feed roller, and paper. The frame comprises a palette surface and roller mounts, the roller mounts adapted to carry the feed and windup rollers. The feed roller and windup roller are each adapted to have the paper rolled around it wherein paper unrolled from the feed roller passes across the palette surface and is rolled up around the windup roller. Also, the frame may have a box-like configuration with the palette surface as the top of the box, and the feed and windup rollers are mounted underneath the palette surface. The assembly may further comprise a connector. The frame may further comprise a storage chamber. Further, the assembly may comprise a feed roller tensioning collar and/or a windup roller tensioning collar.

DETAILED DESCRIPTION OF THE PREFERRED EMBODIMENTS

Figure 1:
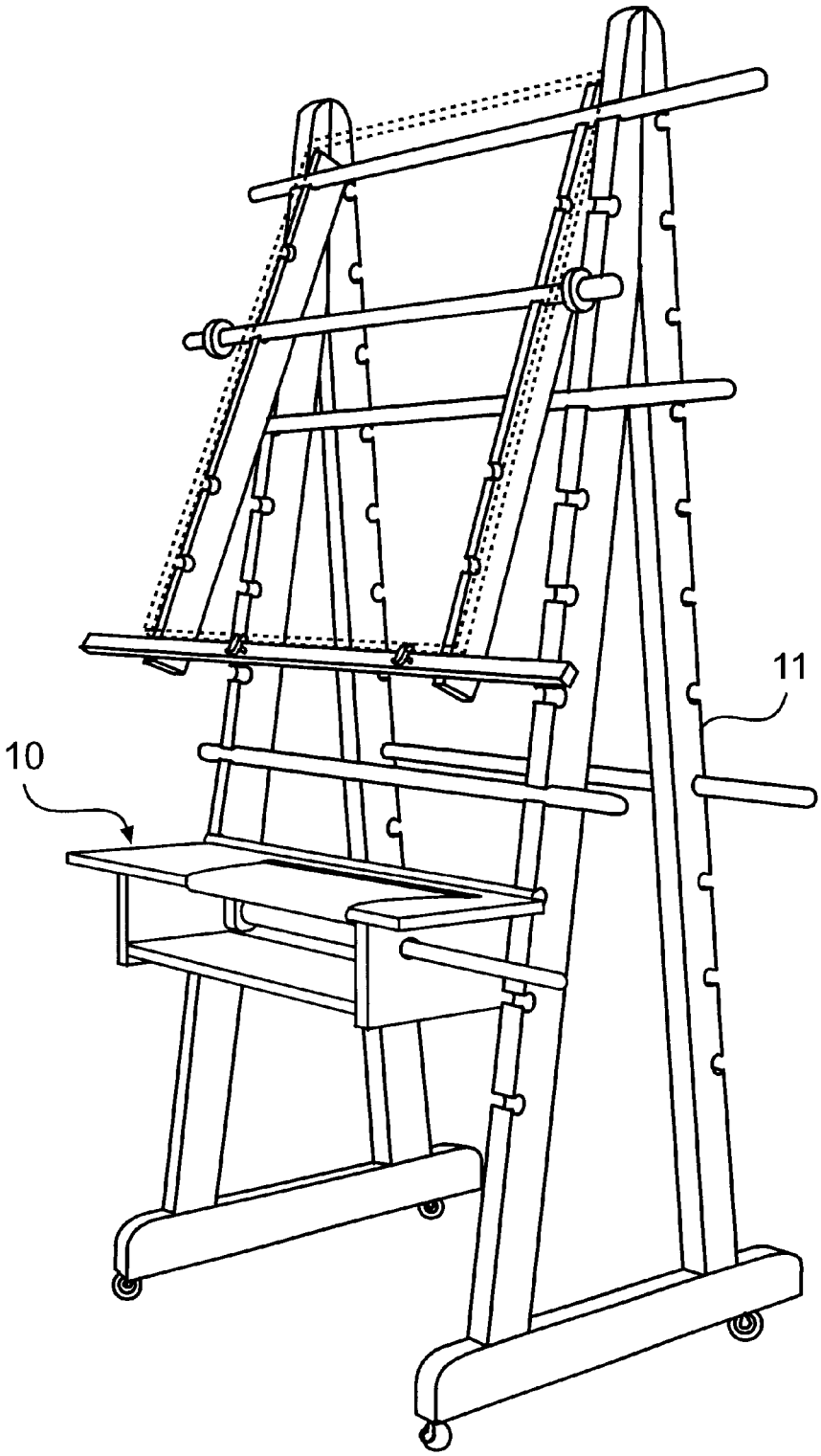
FIG. 1 is a perspective view of an easel onto which is mounted a continuous palette assembly in accordance with the present invention.

FIG. 1 illustrates a very practical application of the present invention. Easel 11 has as one of its attachment features the continuous palette assembly. Obviously, of course, the assembly comprised of frame 10 can be mounted on virtually any type of easel. Specific structural information regarding the easel 11 shown in FIG. 1 is set forth in much greater detail in copending U.S. patent application Ser. No. 09/593,169, which is incorporated herein by reference.

Figure 2:
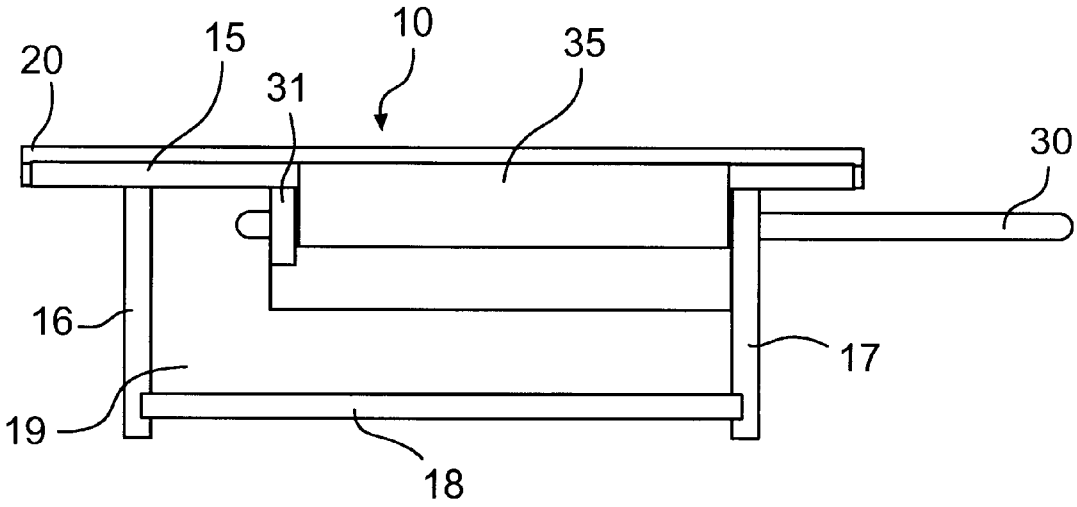
FIG. 2 is a front elevation view of the continuous palette invention as illustrated in FIG. 1.
Figure 3:
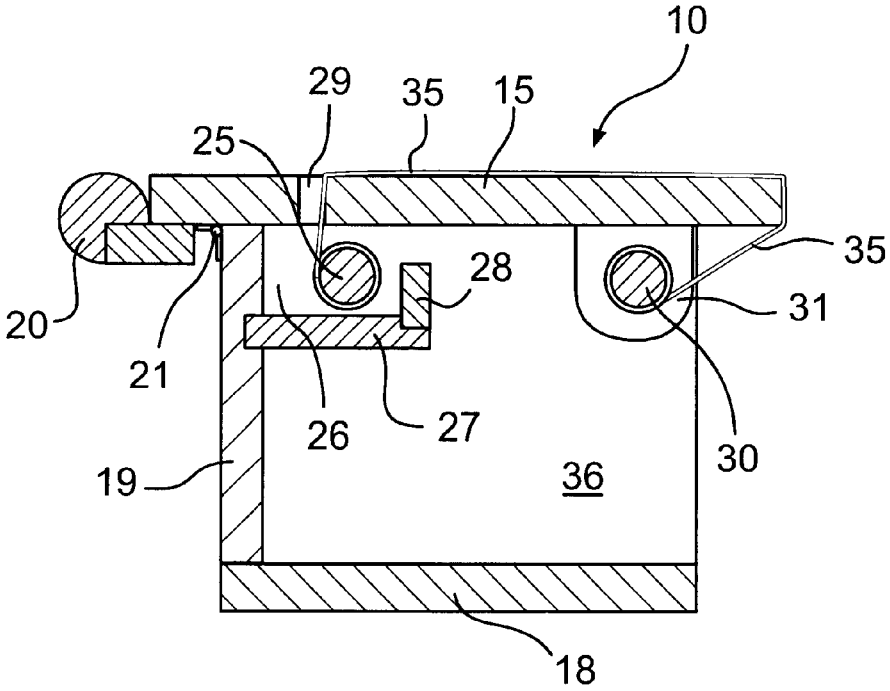
FIG. 3 is a side elevation, cross sectional view of the continuous palette assembly shown in FIG. 1.

Turning next to FIGS. 2 and 3, the continuous palette assembly is shown in greater detail. The frame 10 is made up of a shelf-like or box-like frame including a top wall 15, side walls 16 and 17, a base wall 18, and a back wall 19.

These walls 15–19 are joined together to form a frame having an open shelf 36 there between. Attached to the top wall 15 is a hinge portion 20 which allows the frame 10 to be connected to an easel such as easel 11. Any type of connector may be used including a clamp or a more permanent fixture. In any event, the hinge portion 20 is convenient and preferable because it allows the frame 10 to be optionally moved up and down the easel 11 or removed altogether.

Inside the frame 10 there is a feed chamber 26 defined by wall portions 27 and 28 together with the top wall 15 and back wall 19. Inside the feed chamber 26 there is a feed roller 25 around which is wound paper 35. The top of the feed chamber 26 is open to the top surface of the top wall 15 through an aperture 29. The aperture 29 as shown is wide enough to allow paper 35 to pass through it. Optionally, the aperture 29 may be substantially larger (wider than a roll of paper) to allow the feed roller 25 and paper 35 (or just a roll of paper) to be dropped into the feed chamber 26 from above.

The feed roller 25 may be a core around which a roll of paper is wound. Alternatively, it may be a solid rod as shown that has paper wrapped around it. The feed roller 25 may be simply dropped and loosely held within the feed chamber 26 (as shown). Alternatively, the feed roller 25 may be fixedly mounted to allow for rotational unwinding of paper 35 that is wound around it. (This alternative can be seen in the comparable portions of FIGS. 4 and 5).

Mounted beneath the top wall 15 is windup roller 30 that is mounted onto mount 31 and through a hole in the side wall 17 of the assembly 10. The windup roller 30 extends outside of the assembly 10 so that the windup roller may be manually rotated to wind paper around it.

As shown only in FIG. 3, the frame 10 may include a hinge 21 which allows the top wall 15 to open up, thereby allowing access to the feed chamber 26. As discussed earlier, the aperture 29 may optionally be substantially wider and provide access to the feed chamber through the top wall 15. In that event, a hinge similar to hinge 21 would not be necessary.

Figure 4:
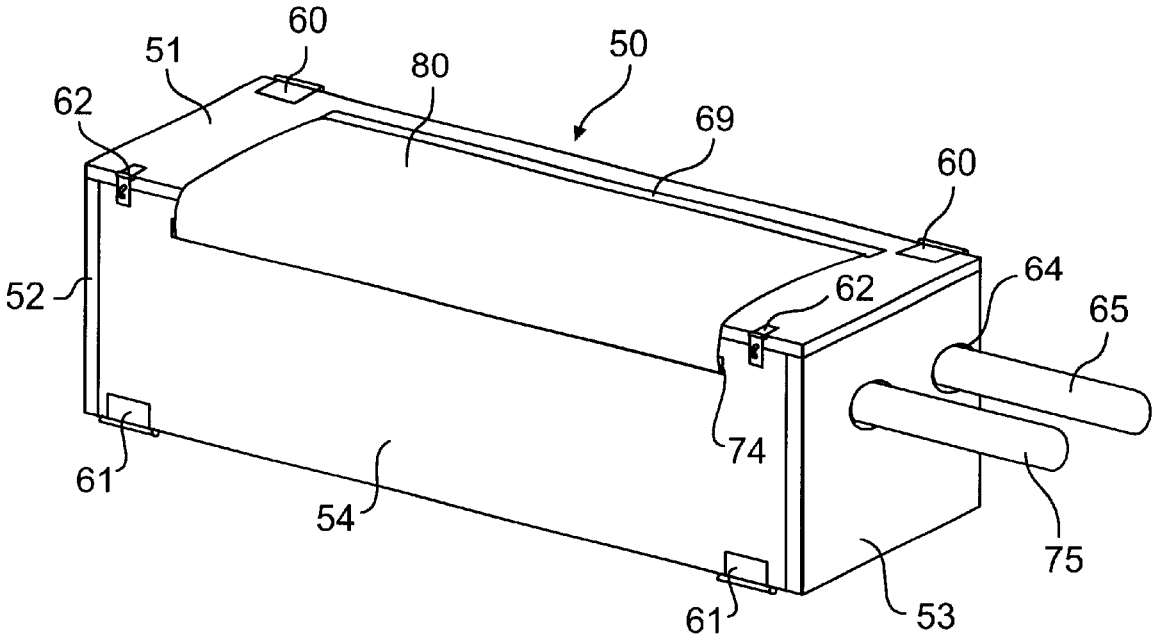
FIG. 4 is a perspective view of an alternative embodiment of a continuous palette assembly in accordance with the present invention.
Figure 5:
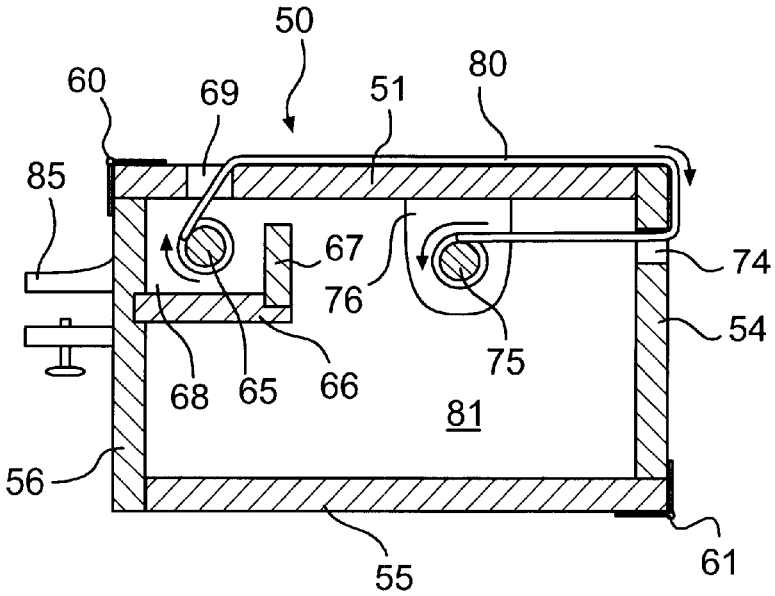
FIG. 5 is a side elevation, cross sectional view of the embodiment of the continuous palette assembly shown in FIG. 4.
Figure 6:
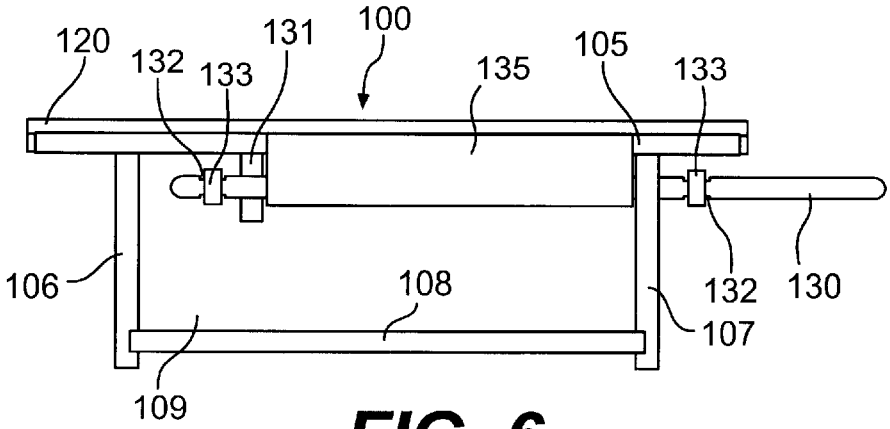
FIG. 6 is a front elevation view of an alternative embodiment of the continuous palette invention.
Figure 7:
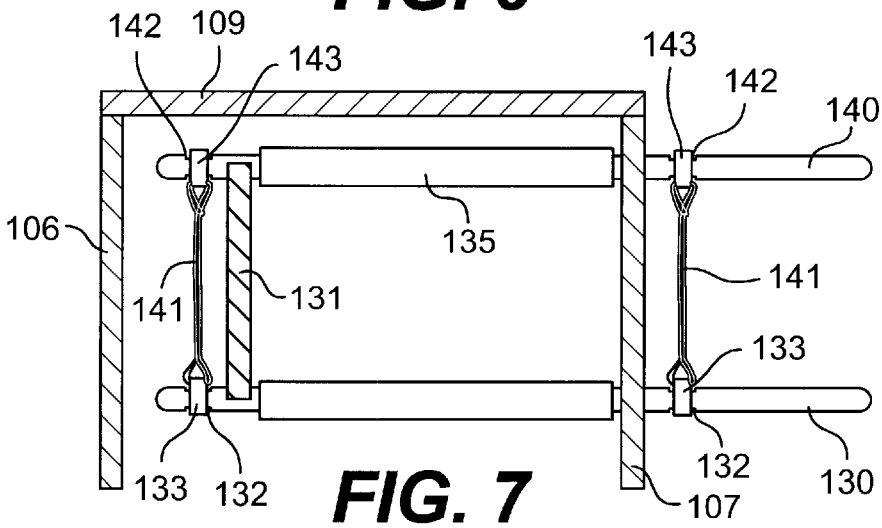
FIG. 7 is a top elevation, cross sectional view of the continuous palette assembly shown in FIG. 6.
Figure 8:
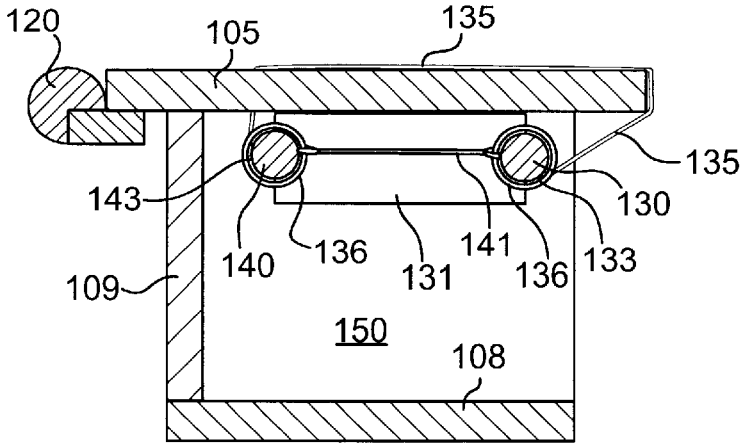
FIG. 8 is a side elevation, cross sectional view of the continuous palette assembly shown in FIG. 6.
Figure 9:
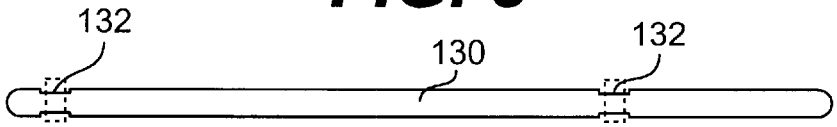
FIG. 9 is a perspective view of the windup roller shown in FIG. 6.

FIGS. 4 and 5 illustrate an alternative embodiment of the present invention where the continuous palette assembly is embodied in a portable painter's box. In other words, the assembly is made up of a box or frame 50 having a top wall 51, end walls 52 and 53, a front wall 54, a bottom wall 55, and back wall 56. Together, the walls 51 through 56 form a box-like configuration. The top wall 51 is hingedly connected to the back wall 56 by hinges 60. The front wall 54 is hingedly connected to the bottom wall 55 by hinges 61. Latches 62 secure the top wall 51 and front wall 54 to create the closed box of the frame 50. Protruding from the frame 50 are feed roller 65 and windup roller 75.

As illustrated more specifically in FIG. 5, inside the frame 50 is feed chamber 68 defined by walls 66 and 67 and top wall 50 and back wall 56. Inside the feed chamber 68 is mounted the feed roller 65 about which is wound paper 80. Aperture 69 is an aperture in the top panel 51 which allows the paper 80 to be fed from the feed chamber 68.

Windup roller 75 is fixed in mount 76 and protrudes through the side wall 53 through hole 64. The windup roller is free to rotate so that paper 80 may be wound around it. The front wall 54 includes an aperture 74 through which paper may pass to the windup roller 75.

A clamp 85 is fixed onto the back wall 56 of the assembly 50 so that the painter's box may be mounted on an easel, post, wall, or not at all. The clamp 85 allows for the easy portability of the frame 50. Other types of connectors than the clamp 85 may be used. Inside the frame 50 is a storage chamber 81 where an artist may store, for instance, paints, brushes, etc.

Referring now to FIGS. 6 through 9, a further embodiment of a continuous palette assembly can be seen. The frame 100 is comprised of a top wall 105, sidewalls 106 and 107, bottom wall 108, and back wall 109. Attached to the top wall 105 is a hinge portion 120 which allows the frame 100 to be connected to an easel such as easel 11 (FIG. 1). The walls 105 through 109 define an open shelf 150 there between.

Underneath the top wall 105 is a mount 131. The mount 131 includes two semicircular notches 136. Rods 130 and 140 extend through holes (not shown) in side wall 107 and are received in the notches 136 in the mount 131. The rods 130 and 140 are the windup roller and feed roller. Depending on which way they are rotated, either rod 130 or 140 can be the feed roller or the windup roller. Each of the rods 130 and 140 has a pair of notches 132 and 142 turned into it. These notches 132 and 142 are adapted to receive tensioning collars 133 and 143. The tensioning collars 133 and 143 are then attached to each other by a spring 141. The spring 141 can be any elastic material or a coiled spring adapted to apply a force to the tensioning collars 133 and 143. The collars 133 and 143 are merely round pieces that allow the rods 130 and 140 to rotate within them. The spring 140 merely applies a force that causes the collars 133 and 143 to frictionally engage the rods 130 and 140. The notches 132 and 142 merely insure that the collars 133 and 143 will not slide off the rods 130 and 140. With respect to the illustrated embodiment, the spring 141 applies a forces that holds the rods 130 and 140 in place in the notches 136 of the mount 131. In operation, the tensioning collars 133 and 143 may merely be slipped off of the rods 130 and 140 thereby allowing those rods to be removed and new paper wound around them or mounted onto them. The practical result of the tensioning collars is to keep the rods 130 and 140 from being able to loosely rotate so that the paper 135 that is wound around the rollers will remain relatively tight and smooth on the palette surface which is the top of the top wall 105.

Also, although not shown, there may be used a tensioning collar around only one of the feed or windup rollers. In that case, a spring can be attached on one end to the tensioning collar and on the other end to a fixed hook or tack on the frame. Still further, although it is preferable to have tensioning collars on each end of the feed and windup rollers, it is possible to mount a collar on only one end.

In either embodiment of the invention, either frame 10, 50 or 100, the operation is similar. Paper is unrolled from the feed roller 25, 65 or 140, and passes across the top of the top wall 15, 51 or 105. The windup roller 30, 75 or 130 then winds up the paper. A user can rotate the windup roller 30, 75 or 130 to draw clean paper from the feed roller 25, 65 or 140. In use, the artist may place paints onto the paper 35, 80 or 135 that is resting on the top wall 15, 51 or 105. The top wall 15, 51 or 105, therefore, acts as a palette surface. Once a painter has used up a portion of the paper 35, 80 or 135, the painter simply winds the windup roller 30, 75 or 130 to windup the dirty paper and to draw clean paper from the feed roller 25, 65 or 140. An additional feature is noted in FIG. 4 (and FIGS. 6–8) wherein the feed roller 65 or 140 may also be manually handled by a user. In this way, for instance, oil paints that have been covered and wound up in the windup roller 75 or 130 may be pulled back by the user by winding the feed roller 65 or 140 in the reverse direction. If properly wrapped up after use, for instance covering the unused paint with plastic wrap, the paint will still be usable by an artist at a later time.

The embodiments illustrated and discussed herein describe a "back-to-front" feed roller/windup roller assembly. Of course, the rollers may be mounted in a "side-to-side" or "front-to-back" relationship. Also, the feed rollers and windup rollers are shown as both being mounted underneath a palette surface. If desirable or structurally preferable, one or both of the rollers could be mounted above the palette surface.

For the purpose of this invention, the paper that may be used in any embodiment is not limited. In other words, the paper may be a conventional cellulosic material. Alternatively, it could be a plastic or plastic-coated material. Still further, wax papers such as freezer paper are excellent choices for this invention, because it prevents the paint from soaking through the paper.

While the invention has been described with reference to specific embodiments thereof, it will be understood that numerous variations, modifications and additional embodiments are possible, and accordingly, all such variations, modifications, and embodiments are to be regarded as being within the spirit and scope of the invention.

What is claimed is:

1. A method of using a continuous palette in combination with an easel comprising the following steps:

providing an easel adapted to support a painter's substrate;

providing a continuous pallette comprising:

a frame attachable to the easel, a windup roller, and a roll of paper, the frame comprising a palette surface and a feed chamber adapted to carry the roll of paper, the feed chamber being open to the palette surface, the windup roller being mounted onto the frame so that the windup roller is free to move rotationally and is adapted to have paper rolled around it;

attaching the pallete to the easel;

unrolling paper from the roll of paper;

passing the paper across the palette surface and attaching it to the windup roller;

placing paint onto the paper that is on the palette surface; and rotating the windup roller to draw clean paper onto the palette surface.

2. A method of using a continuous palette in combination with an easel comprising the following steps:

providing an easel adapted to support a painter's substrate;

providing a continuous pallette comprising:

a frame attachable to the easel, a windup roller, a feed roller, and paper, the frame comprising a palette surface and a feed chamber adapted to carry the feed roller, the feed chamber being open to the palette surface, the windup roller being mounted onto the frame so that the windup roller is free to move rotationally, the feed roller and windup roller each adapted to have the paper rolled around it;

attaching the palette to the easel;

unrolling paper from the feed roller;

passing the paper across the palette surface and attaching it to the windup roller;

placing paint onto the paper that is on the palette surface; and rotating the windup roller to draw clean paper onto the palette surface.

* * * * *